US006315379B1

(12) United States Patent
Adams et al.

(10) Patent No.: US 6,315,379 B1
(45) Date of Patent: Nov. 13, 2001

(54) SYSTEMS AND METHODS FOR SELECTIVELY BLOCKING IMAGE DATA

(75) Inventors: Jerry F. Adams, Waterport; Anthony E. Audi, Rochester; Gary K. Bauer, Ontario; Thomas J. Brockman, Macedon; Bruce A. Collier, Williamson; William M. Lindenfelser, Rochester; Charles A. Ruffino, Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/426,857

(22) Filed: Oct. 26, 1999

(51) Int. Cl.[7] ..... B41J 2/015
(52) U.S. Cl. ..... 347/14; 347/17

(58) Field of Search ..... 347/14, 17, 19, 347/18, 102

(56) References Cited

U.S. PATENT DOCUMENTS 5,107,276 * 4/1992 Kneezel et al. ..... 347/60
5,917,519 * 6/1999 Arai et al. ..... 347/41
5,995,067 * 11/1999 Terasawa et al. ..... 347/14

* cited by examiner

*Primary Examiner*—Anh T. N. Vo
(74) *Attorney, Agent, or Firm*—Oliff & Berridge PLC

(57) ABSTRACT

A printing process determines a maximum pixel printing rate of a printer. An area coverage of an image to be printed is estimated. When the area coverage multiplied by the printing speed exceeds the maximum pixel printing rate, the area coverage of the images to be printed is automatically reduced and the resulting image is printed.

29 Claims, 6 Drawing Sheets

SYSTEMS AND METHODS FOR SELECTIVELY BLOCKING IMAGE DATA

BACKGROUND OF THE INVENTION

1. Field of Invention

This invention relates to ink jet printing systems and methods.

2. Description of Related Art

Continuous stream or drop-on-demand liquid ink printers, such as piezoelectric, acoustic, phase change wax-based or thermal printers, have at least one printhead from which droplets of ink are directed towards a recording medium. Within the printhead, the ink is contained in at least one channel, or preferably in a plurality of channels. Power pulses cause the droplets of ink to be expelled as required from orifices or nozzles at the end of the channels.

In a thermal ink-jet printer, the power pulse is usually produced by a heater transducer or resistor, typically associated with one of the channels. Each heater transducer or resistor is individually addressable to heat and vaporize ink in one of the plurality of channels.

The ink jet printhead may be incorporated into either a carriage type printer, a partial-width-array type printer, or a page-width type printer. The carriage type printer typically has a relative small printhead containing the ink channels and nozzles. The printhead can be sealingly attached to a disposable ink supply cartridge. The combined printhead and cartridge assembly is attached to a carriage, which is reciprocated to print one swath of information at a time on a stationary recording medium, such as paper or a transparency. Each swath has a width equal to the length of a column of nozzles. After each swath is printed, the recording medium is stepped a distance equal to the height of the printed swath or a portion of the swath, so that the next printed swath is contiguous or overlapping with the previously printed swath. This procedure is repeated until the entire page is printed.

The page-width printer includes a stationary printhead having a length sufficient to print across the width or length of a sheet of recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

Many liquid inks, and particularly those used in thermal ink jet printing, include a colorant or dye and a liquid, which is typically an aqueous liquid vehicle, such as water and/or a low vapor pressure solvent. The ink is deposited on the recording medium to form an image in the form of text, graphics and/or pictures. Once deposited, the liquid component is removed from the ink and the recording medium to fix the colorant to the recording medium by either natural air drying or by active drying. In natural air drying, the liquid component of the ink deposited on the recording medium is allowed to evaporate and to penetrate into the substrate naturally without mechanical assistance. In active drying, the recording medium is exposed to heat energy of various types, which can include infrared heating, conductive heating and heating by microwave energy. Active drying of the image can occur either during the imaging process or after the image has been made on the recording medium.

Natural air drying and active dryer each have an operating range. That is, natural air drying and active dryer are not able to dry more than a certain amount of ink per unit of time, called the "ink drying rate". The ink drying rate depends from the humidity and the temperature of the ambient air.

SUMMARY OF THE INVENTION

The pixel printing rate of a document is defined by the number of pixels to be printed during a unit of time. The pixel printing rate is proportional to the area coverage of each sheet of recording medium multiplied by the speed of the printer, i.e., the number of pages printed per minute.

In most printers, the ink drying rate of a printer is typically less than the maximum pixel printing rate that the printer can reach, because most printed documents, and particularly those that do not incorporate photographs or other graphics elements, have an area coverage less than about five percent. Even documents including very high density photographs have an area coverage generally less than about fifty percent.

However, when the pixel printing rate exceeds the ink drying rate on a previous printed document, some ink may remain liquid on this previous printed document when the next document is printed and, thus, the next printed document may be spotted by the liquid ink remaining on the previous document.

In thermal ink jet printers, the amount of power delivered to the heater transducers or resistors incorporated in the printhead is dependent on the rate at which pixels are printed, which is in turn a function of the area coverage and the process speed. If the amount of power of the power supply exceeds a threshold amount, the power supply could become damaged. This damage can occur due to various physical effects, such as temperature, current density, etc. Much of the power delivered to the resistors remains in the printhead after the pixel is printed. This power generates heat, which increases the temperature of the printhead. In order to maintain a temperature of the printhead in an operating range of temperatures, the excess heat must be removed. Otherwise, the printhead or the quality of the printed documents could deteriorate.

Accordingly, the design of the print head is affected by the maximum pixel printing rate. In the same way, the cooling system, the driving cost, the complexity of the printer and its size are affected by the maximum pixel printing rate.

In a variable speed architecture, a printer controller monitors the pixel printing rate. When the pixel printing rate exceeds a specified threshold, the printer controller reduces the process speed. Thus, the pixel printing rate remains below the specified threshold regardless of the area coverage of the images to be printed.

This invention provides systems and methods for printing documents at full speed, regardless of the pixel printing rate of the image to be printed.

In a first exemplary embodiment of the systems and methods according to this invention, when an image area coverage exceeds a predetermined threshold corresponding to a predetermined maximum pixel printing rate, the printed image area coverage is reduced relative to the input image area coverage, to obtain a pixel printing rate that is less than the maximum pixel printing rate.

In a second exemplary embodiment of the systems and methods according to this invention, a printing mode is selected between a full-speed variable density printing mode and a full-density variable speed printing mode. In the full-speed variable density printing mode, when the image area coverage exceeds a predetermined threshold corresponding to a predetermined maximum pixel printing rate, a selected printing mode is performed.

According to exemplary embodiments of the systems and methods according to this invention, a printhead temperature sensor and/or an ambient humidity sensor can be provided to define the predetermined threshold.

According to other exemplary embodiments of the systems and methods according to this invention, the image area coverage compared to the threshold is the image area coverage of one sheet of recording medium to be printed.

According to other exemplary embodiments of the systems and methods according to this invention, a ratio p/n of pixel to be dropped out is determined according to the image area coverage and p pixels out of n pixels to be printed are drop out of the image to be printed.

According to other exemplary embodiments of the systems and methods according to this invention, the resolution used by the printer driver is reduced when the image area coverage is higher than the predetermined threshold.

These and other features and advantages of this invention are described in or are apparent from the following detailed description of the apparatus/systems and methods according to this invention.

BRIEF DESCRIPTION OF THE DRAWINGS

Various exemplary embodiments of this invention will be described in detail, with reference to the accompanying drawings, wherein.

DETAILED DESCRIPTION OF PREFERRED EMBODIMENTS

Figure 1:
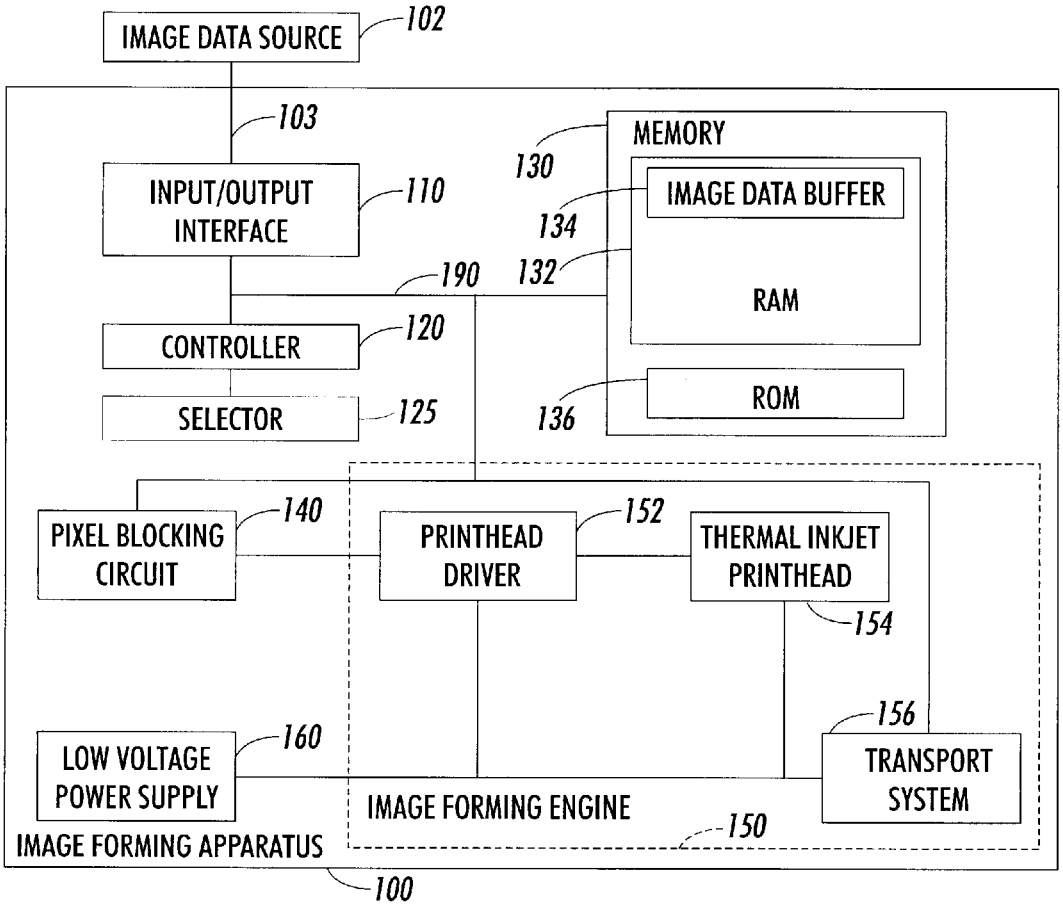
FIG. 1 is a function block diagram of a first exemplary embodiment of an ink jet printer according to the systems and methods of this invention.

FIG. 1 is a functional block diagram outlining one exemplary embodiment of an image forming apparatus 100. An image data source 102 supplies image print data to the image forming apparatus 100 through a link 103. The image forming apparatus 100 includes an input/output interface 110, a controller 120, a selector 125, a memory 130, a pixel blocking circuit 140, an image forming engine 150, each connected to a data/control bus 190 and a low voltage power supply 160. The image forming engine 150 includes a printhead driver 152, a thermal ink jet printhead 154 and a transport system 156.

In the exemplary embodiment of the systems according to this invention shown in FIG. 1, the image forming apparatus 100 may be a carriage type ink-jet printer, a page-width printer, a laser printer, a thermal printer, a typewriter, a digital copier, an analog copier or any other device that is capable of producing an image output within a limited operating range.

In the image forming apparatus 100 shown in FIG. 1, the thermal ink jet printhead 154 is a thermal page width array (PWA) ink jet printhead that ejects drops of ink from individual printhead nozzles. However, in other exemplary embodiments of the image forming apparatus 100, the printhead 154 may eject liquid, solid, gel or powdered chemical products on a recording medium or on an image transfer body where an image is developed.

The link 103 can be any known or later developed device or system for connecting the data source 102 to the image forming apparatus 100, including a direct cable connection, a wireless connection, a connection over a wide area network or a local area network, a connection over an intranet, a connection over the Internet, or a connection over any other distributed processing network or system. In general, the link 103 can be any known or later developed connection system or structure usable to connect the data source 102 to the image forming apparatus 100.

While FIG. 1 shows the data source 102 as a separate device from the image forming apparatus 100, the data source 102 may be an integrated device, such as a digital copier, computer with a build-in printer, or any other integrated device that is capable of producing a hard copy image output.

In general, the image data source 102 can be any one of a number of different sources, such as a video camera, a still camera, a scanner, a digital copier, a facsimile device or a computer that is suitable for generating electronic image data, or a device suitable for storing and or transmitting electronic image data, such as a client or server of a network. For example, the image data source 102 may be a data carrier such as a magnetic storage disk, CD-ROM or the like, or a host computer, that contains scanned image data.

The memory 130 includes a non-volatile memory 136 that stores control programs for the image forming apparatus 100 and a random access memory 132 that includes the image data buffer 134 for storing the image data from the image data source.

The image data is provided to an image data buffer 134 of the memory 130, through the link 103, the input/output interface 110 and the control/data bus 190. The image data source 102 can provide monochrome or color, compressed images or non-compressed images, electronic files representing text, graphics and or pictures. When the image data provided by the image data source 102 does not include, for each picture element of the image to be printed, an image data representing the pixel value ("on" when the picture element correspond to an ink drop and "off" otherwise), the controller 120 converts the received image data into series of pixel values each corresponding to the pixel value of a picture element of the image to be printed and supplies the resulting image data to the image data buffer 134.

The image data are supplied to the image data buffer 134 at a rate controlled by the controller 120. The buffer memory 134 stores image data for a predetermined number of scan lines. In the image forming apparatus 100 shown in FIG. 1, the number of scan lines stored in the image data buffer 134 corresponds to the largest sheet of recording medium that the image forming apparatus 100 can print. However, in other exemplary embodiments of the image forming apparatus 100, other number of lines may be used and other way to store image data may be used.

The controller 120 is counting the turned-on pixels for each printed color, in the image data stored in the buffer memory 134. The controller 120 stores the number of turned-on pixels in the image, the pixel count value, into the random access memory 132. Pixels of the image are said to be turned-on when they are intended to correspond to an ink drop. As explained below, the number of pixels turned-on is used to determine the image coverage area.

The buffer memory 134 provides image data to the pixel blocking circuit 140 and the pixel blocking circuit 140 provides image data to the printhead driver 152. The printhead driver 152 includes driver electronics that provide power to eject a drop of ink from individual printhead nozzles within the thermal ink jet printhead 154. The printhead driver 152 controls the operation of the printhead 154. The pixel blocking circuit 140 turns off p turned-on pixels out of n in the image to be printed. The controller 120 determines the numbers p and n. In the image forming apparatus 100, the pixel blocking circuit 140 is a set of counters. In other exemplary embodiments of the image forming apparatus 100, the pixel blocking circuit 140 may be implemented as a function of a control executed by the controller 120, or may be an ASIC, a printed circuit, a general purpose controller or any other type of electronic circuit.

The controller 120 is connected to the transport system 156 that transports or moves the image recording medium (e.g. paper) through the image forming apparatus 100 and past the printhead 154. The transport system 156 generally includes paper transport mechanisms, such as conveyors, rollers or other conventional transport elements and associated electronics used to transport or move the image recording medium.

The low voltage power supply 160 is designed to provide at most a threshold amount of power. The low voltage power supply 160 will be required to supply more power as the pixel printing rate increases. According to the first exemplary embodiment of the systems and methods of this invention, the controller 120 uses the pixel count value stored in the random access memory 132 to predict the change in the power demand on the low voltage power supply 160. That is, the power demand on the low voltage power supply 160 will either rise, remain the same or decrease based on the pixel printing rate, which is proportional to the image area coverage multiplied by the printing speed.

This relationship is determined through testing and is placed into a lookup table (not shown) in the non-volatile memory 136. The controller 120 determines when continued processing at the process, or printing, speed selected by the selector 125 for this set of image data, for example, full speed, will cause the amount of power to be supplied by the low voltage power supply to exceed its operating power demand threshold. When this occurs, the controller 120 causes the printed image area coverage to be less than the input image area coverage. This is performed by the pixel blocking circuit 140, which turns off a portion p/n of the turned-on pixels.

As the reduced image area coverage reduces the total power supplied by the low voltage power supply 160, the power demands on the low voltage power supply 160 is controlled to keep the amount of supplied power below the threshold amount of power while still providing the selected printing speed.

Similarly, the printhead 154 is designed to operate with a printhead temperature in a predetermined range of operating temperatures. According to the first exemplary embodiment of the systems and methods of this invention, the controller 120 uses the pixel count value stored in the random access memory 132 to predict the change in printhead temperature. That is, the temperature of the printhead 154 will either rise, remain the same or decrease based on the pixel printing rate, which is proportional to the image area coverage multiplied by the printing speed.

This relationship is determined through testing and is placed into a lookup table (not shown) in the non-volatile memory 136. The controller 120 determines when continued processing at the process, or printing, speed selected for this set of image data, for example, full speed, will cause the printhead temperature to exceed its designed operating temperature range. When this occurs, the controller 120 causes the printed image area coverage to be less than the input image area coverage. This is performed by the pixel blocking circuit 140, which turns off a portion p/n of the turned-on pixels.

As the reduced image area coverage reduces the total power applied to the thermal ink jet printhead 154, the temperature of the thermal ink jet printhead 154 is controlled to remain within the operating temperature range while still providing the selected printing speed.

In the various exemplary embodiments of the methods according to this invention, the pixel blocking ratio p/n is determined for one full sheet of recording medium to be printed out. However, in other exemplary embodiments, the pixel blocking ratio p/n can be determined for portions of sheets or for a plurality of sheets.

In the general operation of the image forming apparatus according to this exemplary embodiment of the system of this invention, when image data is received, the selected printing speed is determined. An input image then received is stored and the turned-on pixels for each color of the stored image are counted. The power demand on the low voltage power supply is predicted, based on a look-up table, the selected printing speed and the number of turned-on pixels multiplied by a ratio (n-p)/n, where n is a predetermined value. If the predicted power demand exceeds the operating threshold power demand of the low voltage power supply, the value of p is incremented and a new predicted power demand is determined. The future temperature of the printhead can also be predicted, based on a look-up table, the previous predicted temperature, the selected printing speed and the number of turned-on pixels multiplied by a ratio (n-p)/n, where n is a predetermined value. If the predicted temperature exceeds the operating temperature range of the printhead, the value of p is incremented and a new predicted temperature is determined. Otherwise, the stored image is printed by the printhead at the selected printing speed after turning off p out of n turned-on pixels of the stored image.

Specifically, in the exemplary embodiment of the image forming apparatus 100 shown in FIG. 1, the controller 120 first waits for image data to be supplied by the image data source 102. When image data is received from the image data source 102, the controller 120 determines the selected printing speed.

The controller 120 can determine the selected printing speed in a variety of ways. In one exemplary embodiment, the selected printing speed can be determined indirectly, and automatically, based on the printing mode selected by the user. That is, when the user, using the selector 125 selects the variable density printing mode, the printing speed used in the variable density printing mode is predetermined, and the actual printing speed is set to that predetermined printing speed. In general, the predetermined printing speed for the variable density printing mode will be the maximum printing speed of the printer. However, it should be appreciated that any printing speed that the printer is capable of, could be used as the predetermined printing speed for the variable density printing mode.

In a second exemplary embodiment, the selected printing speed is determined as a printing speed selected by the user using the selector 125. This selector 125 can be any known or later developed device such as a dialog box of a graphical user interface, a series of menus and/or buttons of an interface panel of the printer, or the like. The printing speed selected by the user is stored in the random access memory 132.

In a third exemplary embodiment, the printing speed is selected at least in part on the size of the image data to be printed. In particular, this third exemplary embodiment can be combined with either of the first and second exemplary embodiments, or used on its own.

In this third exemplary embodiment, once a base printing speed is selected or otherwise determined, the base printing speed is altered based on the size of the image data to be printed. In one version of this third exemplary embodiment, as the number of sheets to be printed increases, the higher the printing speed becomes or remains. In contrast, as the number of sheets to be printed decreases toward one, the slower the printing speed becomes or remains. This is done because a user is more likely to accept a lower speed, higher density print for a small document than for a large document. For example, if only one sheet of image data will be printed, the user is likely to accept a printing speed that doubles the printing time for that one sheet if that means that only a small number of areas will requires pixels to be turned off. In contrast, the user is highly unlikely to accept this when the image data requires fifty sheets to be printed.

The controller 120 then controls the input of data corresponding to an input image from the data source 102 to the image data buffer memory 134. The image data buffer memory 134 stores the input image data corresponding to one sheet to be printed. The controller 120 also counts the turned-on pixels for each color of the image stored in the image data buffer 134 and stores the counter value for each color in the random access memory 132.

The controller 120 sets the value of a counter p stored in the random access memory 132 to zero. Next, the controller 120 predicts the future amount of power to be supplied by the low voltage power supply 160. This future amount of power to be supplied is obtained by inputting, into a look-up table (not shown) stored in the non-volatile memory 136, the selected printing speed, and the number of turned-on pixels multiplied by the ratio (n-p)/n and by reading the output of the look-up table. In general, n is a predetermined value stored in the non-volatile memory 136.

The controller 120 then determines whether the predicted future amount of power to be supplied exceeds the threshold power demand of the low voltage power supply 160. If so, the controller 120 increments the value of p. The controller 120 determines a new predicted amount of power to be supplied based on the new value of p. In particular, the controller 120 iteratively determines if the predicted amount of power to be supplied exceeds the operating power demand threshold of the low voltage power supply 160, increments the value of p and determines a new predicted amount of power to be supplied until the predicted amount of power to be supplied does not exceed the threshold power demand of the low voltage power supply 160.

If the printhead temperature is controlled in addition to or in place of the amount of power supplied by the low voltage power supply, the controller 120 predicts the future temperature of the printhead 154. This future temperature is obtained by inputting, into a look-up table (not shown) stored in the non-volatile memory 136, the previous predicted temperature stored in the random access memory 132, the selected printing speed, and the number of turned-on pixels multiplied by the ratio (n-p)/n and by reading the output of the look-up table. In general, n is a predetermined value stored in the non-volatile memory 136.

The controller 120 then determines whether the predicted future temperature exceeds the temperature operating range of the printhead 154. If so, the controller 120 increments the value of p. The controller 120 determines a revised predicted temperature based on the new value of p. In particular, the controller 120 iteratively determines if the predicted temperature exceeds the temperature operating range of the printhead 154, increments the value of p and determines a new predicted temperature until the predicted temperature does not exceed the temperature operating range of the printhead 154.

The predicted temperature determined by the controller 120 is stored into the random access memory 132. The input image is read from the image data buffer 134 and is transmitted to the pixel blocking circuit 140 which turns off p out of n turned-on pixels of the input image. The resulting image is printed then by the printhead 154 at the selected printing speed.

Figure 2:
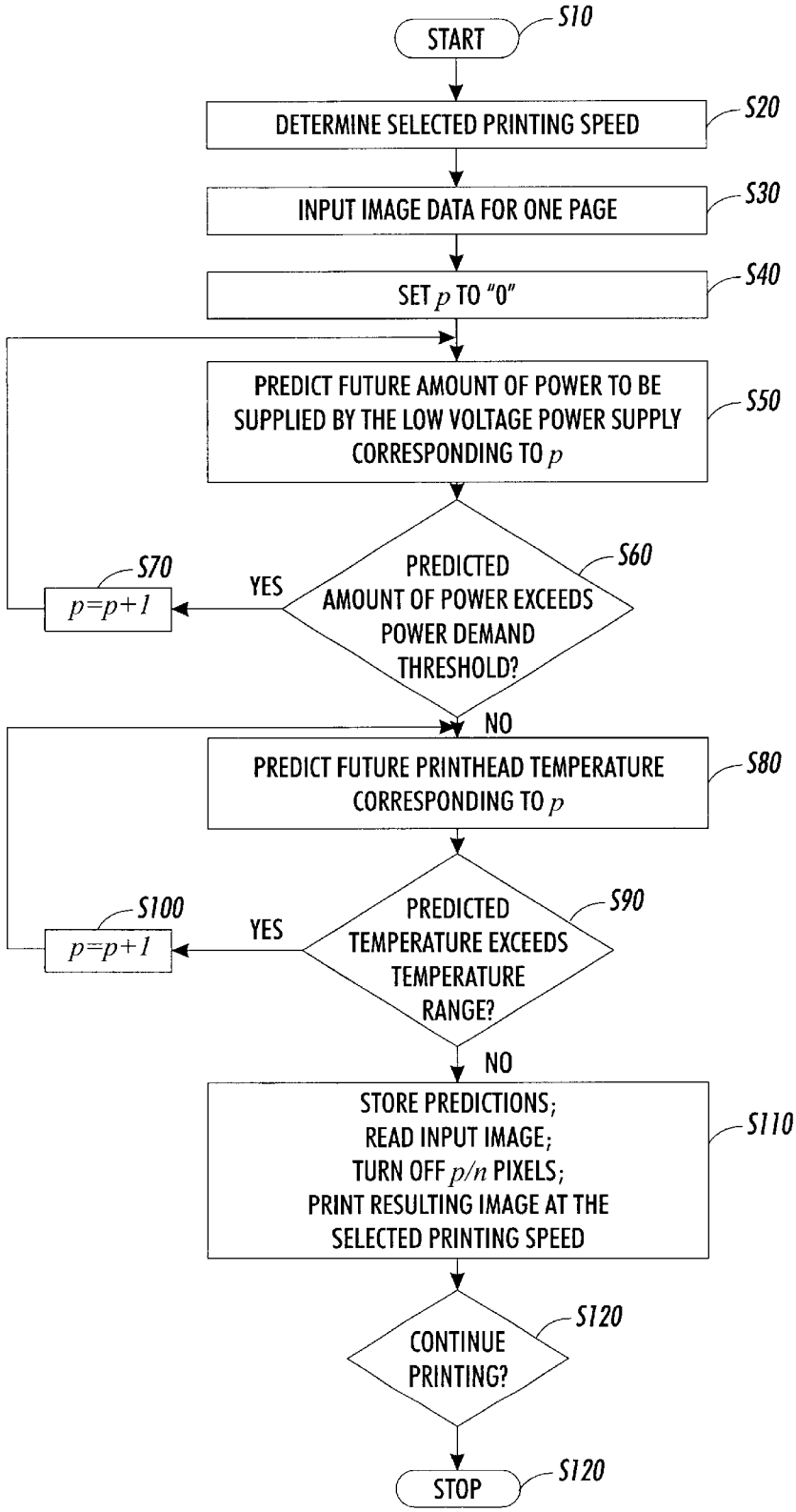
FIG. 2 is a flowchart outlining a first exemplary method according to this invention.

FIG. 2 is a flowchart of a first exemplary embodiment of the method according to this invention. In particular, this first exemplary embodiment of the method is usable by the ink jet printer shown in FIG. 1.

Beginning in step S10, control continues to step S20, where the selected printing speed is determined. Next, in step S30, image data for an input image is input and the number of turned-on pixels for each color of the input image is counted. Then, in step S40, the value of a variable p is set to zero. Control then continues to step S50.

In step S50, the future amount of power to be supplied by the low voltage power supply 160 is predicted. This predicted future amount of power to be supplied is obtained based the selected printing speed determined in step S20, and the number of turned-on pixels multiplied by the ratio (n-p)/n. In particular n is a predetermined value. Then, in step S60, a determination is made whether the predicted future amount of power to be supplied exceeds the power demand threshold of the low voltage power supply 160. When the predicted amount of power to be supplied exceeds the power demand threshold of the low voltage power supply 160, control continues to step S70. Otherwise, control jumps to step S80.

In step S70, the value of p is incremented. Control then returns to step S50.

In contrast, in step S80, the future temperature of the printhead 154 is predicted. This predicted future temperature is obtained based on the previous predicted temperature, if any, the selected printing speed determined in step S20, and the number of turned-on pixels multiplied by the ratio (n-p)/n. In particular n is a predetermined value. Then, in step S90, a determination is made whether the predicted future temperature exceeds the temperature operating range of the printhead. When the predicted temperature exceeds the temperature operating range, control continues to step S100. Otherwise, control jumps to step S110.

In step S100, the value of p is incremented. Control then returns to step S80. In contrast, in step S110, the predicted temperature of the printhead 154 is saved, the input image is read, p out of n turned-on pixels of the input image are turned off, and the resulting image is printed at the selected printing speed. Control then continues to step S120. In step S120, a determination is made whether another page is to be printed. If so, control returns to step S20. Otherwise, control continues to step S130 where the process stops.

It should be appreciated that, if the printhead temperature is not controlled, steps S80–S100 can be omitted. Likewise, if the power demand on the low voltage power supply is not controlled, steps S50–S70 can be omitted.

Figure 3:
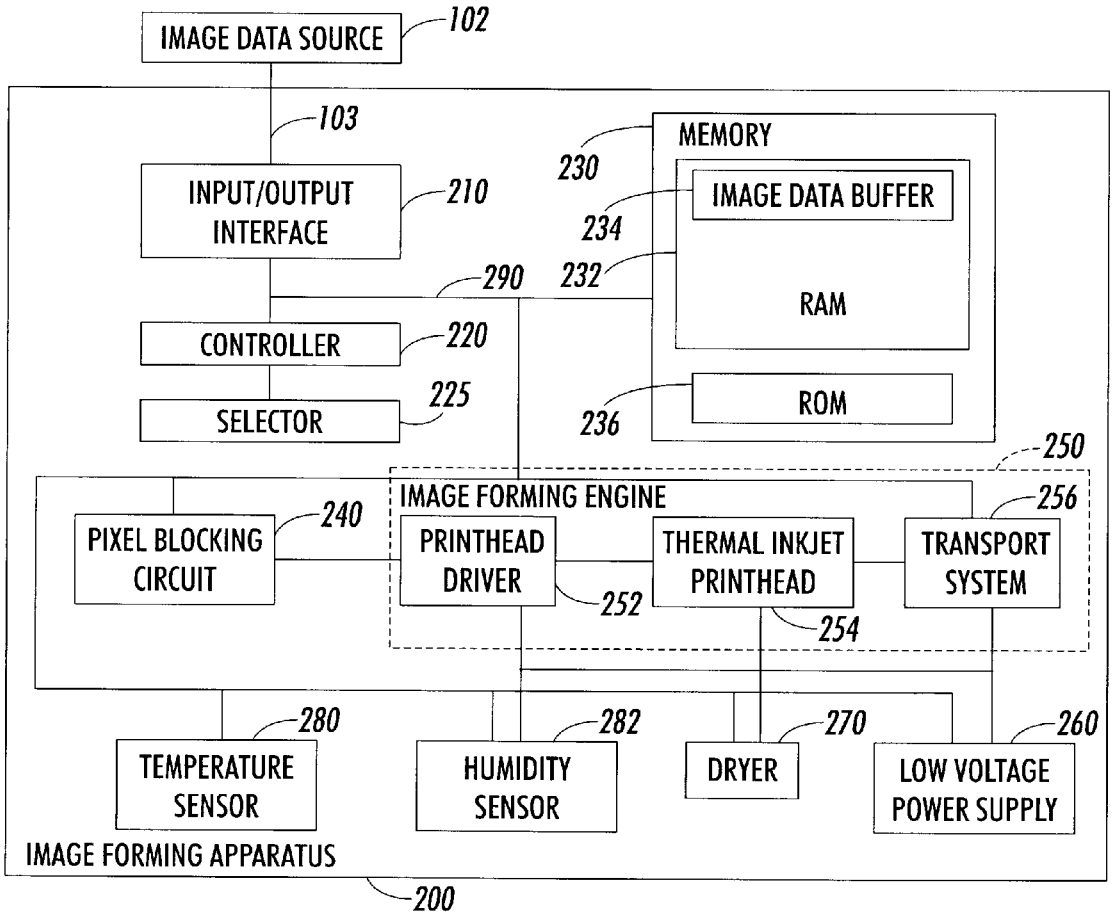
FIG. 3 is a functional block diagram of a second exemplary embodiment of an ink jet printer according to the systems and methods of this invention.

FIG. 3 is a functional block diagram illustrating a second exemplary embodiment of an image forming apparatus 200 according to the systems and methods of this invention. The image data source 102 supplies image print data to the image forming apparatus 200 through the link 103. The image forming apparatus 200 includes an input/output interface 210, a controller 220, a memory 230, a pixel blocking circuit 240, an image forming engine 250, a low voltage power supply 260, a dryer 270, a temperature sensor 280 and a humidity sensor 282, each connected to a data/control bus 290.

The image forming engine includes a printhead driver 252, a thermal ink jet printhead 254 and a transport system 256. The memory 230 includes a non-volatile memory 236 that stores the program for running the controller 220 and a random access memory 232 that includes an image data buffer 234 for storing the image data from the image data source.

In the exemplary embodiment of the image forming apparatus 200 according to this invention shown in FIG. 3, the image forming apparatus 200 may be a carriage type ink-jet printer, a page-width printer, a laser printer, a thermal printer, a typewriter, a digital copier, an analog copier or any other device that is capable of producing an image output within a limited operating range.

In the image forming apparatus 200 shown in FIG. 3, the thermal ink jet printhead 254 is a thermal page width array (PWA) ink jet printhead that ejects drops of ink from individual printhead nozzles. However, in other exemplary embodiments of the image forming apparatus 200, the printhead 254 may eject liquid, solid, gel or powdered chemical products on a recording medium or on an image transfer body where an image is developed.

While FIG. 3 shows the data source 102 as a separate device from the image forming apparatus 200, the data source 102 may be an integrated device, such as a digital copier, computer with a build-in printer, or any other integrated device that is capable of producing a hard copy image output.

The memory 230 includes a non-volatile memory 236 that stores control programs for the image forming apparatus 200 and a random access memory 232 that includes the image data buffer 234 for storing the image data from the image data source. The image data is provided to an image data buffer 234 of the memory 230, through the link 103, the input/output interface 210 and the control/data bus 290. When the image data provided by the image data source 102 does not include, for each picture element of the image to be printed, an image data representing the pixel value ("on" when the picture element correspond to an ink drop and "off" otherwise), the controller 220 converts the received image data into series of pixel values each corresponding to the pixel value of a picture element of the image to be printed and supplies the resulting image data to the image data buffer 234.

The image data are supplied to the image data buffer 234 at a rate controlled by the controller 220. The buffer memory 234 stores image data for a predetermined number of scan lines. In the image forming apparatus 200 shown in FIG. 3, the number of scan lines stored in the image data buffer 234 corresponds to the largest page that the image forming apparatus 200 can print. However, in other exemplary embodiments of the image forming apparatus 200, other number of lines may be used and other way to store image data may be used.

The controller 220 counts the turned-on pixels for each printed color in the image data stored in the buffer memory 234. The controller 220 stores the number of turned-on pixels in the image, the pixel count value for each color into the random access memory 232. Pixels of the image are turned-on when they are intended to correspond to an ink drop. As explained above with respect to FIG. 1, the number of turned-on pixels is used to determine the image coverage area.

The buffer memory 234 provides image data to the pixel blocking circuit 240 and the pixel blocking circuit 240 provides revised image data to the printhead driver 252. The printhead driver 252 includes driver electronics that provide power to eject a drop of ink from individual printhead nozzles within the thermal ink jet printhead 254. The printhead driver 252 controls the operation of the printhead 254. The pixel blocking circuit 240 turns off p turned-on pixels out of n in the image to be printed. The controller 220 determines the numbers p and n. In the image forming apparatus 200, the pixel blocking circuit 240 is a set of counters. In other exemplary embodiments of the image forming apparatus 200, the pixel blocking circuit 240 may be implemented as a function of a control executed by the controller 220, or may be an ASIC, a printed circuit, a general purpose controller or any other type of electronic circuit.

The controller 220 is connected to the transport system 256 that transports or moves the image recording medium (e.g., paper) through the image forming apparatus 200 and past the printhead 254. The transport system 256 generally includes paper transport mechanisms, such as conveyors, rollers or other conventional transport elements and associated electronics used to transport or move the image recording medium.

The low voltage power supply 260 supplies electric power to each electrical component of the image forming apparatus 200. Moreover, the low voltage power supply 260 provides a signal representative of the amount of electrical power supplied to the thermal ink jet printhead 254. This signal can be read by the controller 220 on the data/control bus 290.

The temperature sensor 280 provides a signal that represents the ambient temperature when the image forming apparatus 200 is initialized, and the temperature of the thermal printhead 254 when the image forming apparatus 200 is in operation. This signal can be read by the controller 220 on the data/control bus 290. The humidity sensor 282 provides a signal representative of the humidity of the air surrounding the image forming apparatus 200. This signal also can be read by the controller 220 on the data/control bus 290. Thus, it should be appreciated that the output signal from temperature sensor 280, the output signal from the low voltage power supply 260 and the output signal from the humidity sensor 282 are converted into digital signals and then provided to the controller 220.

The output signal from the temperature sensor 280 is used by the controller 220 along with the output signal from the low voltage power supply 260 to predict the change in printhead temperature and to determine whether the printhead 254 will exceed operating temperature threshold. That is, the temperature of the printhead 254 will either rise, remain the same or decrease based on the electrical intensity supplied to the printhead 254 and the actual current printhead temperature. This relationship is determined through testing and is placed into a lookup table in the non-volatile memory 236 for use by the controller 220. However, as actual current printhead temperature is known, the predicted temperature of the printhead 254 after printing the image stored in buffer memory 234 can be more accurately determined than in the image forming apparatus 100 as shown in FIG. 1.

The output signal from the low voltage power supply 260 is also used by the controller 220 to predict the change in the amount of power to be supplied by the low voltage power supply and to determine whether the amount of power to be supplied by the low voltage power supply 260 will exceed its power demand threshold. That is, the amount of power to be supplied by the low voltage power supply 260 will either rise, remain the same or decrease based on the pixel printing rate. This relationship is determined through testing and is placed into a lookup table in the non-volatile memory 236 for use by the controller 220.

The dryer 270 is designed to dry a certain amount of ink per unit of time when the ambient air has a given humidity level. This amount is called the ink drying rate. However, the actual ink drying rate depends from the humidity level of the ambient air. The more humid the ambient air, the lower the actual ink drying rate becomes. The signal output by the humidity sensor 282 is used by the controller 220 to determine this actual ink drying rate of dryer 270. The relationship between the ambient air humidity level and the ink drying rate is determined through testing and is be placed into a lookup table in the non-volatile memory 236.

The controller 220 uses the electrical intensity supplied by the low voltage power supply 260 to the printhead 254 to determine the amount of ink to be dried. In the image forming apparatus 200 shown in FIG. 3, the amount of ink to be dried per unit of time is proportional to this electrical intensity.

The image forming apparatus 200 operates according to two different operating modes, a variable speed mode and a variable density mode that corresponds to the operating mode explained with regard to FIG. 2.

In operation, if the variable density operating mode is selected by the selector 225, when the controller 220 determines that continued processing at the process, or printing, speed selected for this set of image data, for example, full speed, will cause the amount of power to be supplied by the low voltage power supply to exceed its designed operating power demand threshold, the controller 220 causes the printed image area coverage to be less than the input image area coverage. This is performed by means of the pixel blocking circuit 240 which turns off a portion p/n of the turned-on pixels. Accordingly, the area coverage of the printed image is reduced to a level that keeps the amount of power to be supplied by the low voltage power supply 260 below its power demand threshold while still providing the same printing speed.

Moreover, if the variable density operating mode is selected by the selector 225, when the controller 220 determines that continued processing at the process, or printing, speed selected for this set of image data, for example, full speed, will cause the amount of ink to be dried to exceed the ink drying rate, the controller 220 causes the printed image area coverage to be less than the input image area coverage, by means of the pixel blocking circuit 240. As reduced image area coverage will reduce the amount of ink to be dried, this amount can also be controlled to remain less than the ink drying rate while still providing the same printing speed.

Furthermore, if the variable density operating mode is selected by the selector 225, when the controller 220 determines that continued processing at the process, or printing, speed selected for this set of image data, for example, full speed, will cause the printhead temperature to exceed its designed operating temperature range, the controller 220 causes the printed image area coverage to be less than the input image area coverage. This is performed by means of the pixel blocking circuit 240 which turns off a portion p/n of the turned-on pixels. Accordingly, the area coverage of the printed image is reduced to a level that keeps the printhead 254 within its operating temperature range while still providing the same printing speed.

However, if the variable speed operating mode is selected by the selector 225, when the controller 220 determines that continued processing at the process, or printing, speed selected for this set of image data, for example, full speed, will cause the amount of power to be supplied by the low voltage power supply to exceed its designed operating power demand threshold, the controller 220 causes the transport system 256 to reduce the printing speed. Accordingly, the pixel printing rate is reduced and the amount of power supplied by the low voltage power supply 260 is reduced to a level below the operating power demand threshold while still providing the same area coverage.

Also, if the variable density operating mode is selected by the selector 225, when the controller 220 determines that continued processing at the process, or printing, speed selected for this set of image data, for example, full speed, will cause the amount of ink to be dried to exceed the ink drying rate, the controller 220 causes the transport system 256 to further reduce the printing speed. Accordingly, the amount of ink to be dried per unit of time is reduced to a level that is less than the ink drying rate while still providing the same area coverage.

Moreover,if the variable speed operating mode is selected by the selector 225, when the controller 220 determines that continued processing at the process, or printing, speed selected for this set of image data, for example, full speed, will cause the printhead temperature to exceed its designed operating temperature range, the controller 220 causes the transport system 256 to further reduce the printing speed. Accordingly, the pixel printing rate is reduced and the amount of power delivered to the printhead per unit of time is reduced to a level that keeps the printhead 254 within its operating temperature range while still providing the same area coverage.

In the general operation of the image forming apparatus according to this exemplary embodiment of the system of this invention, when the image forming apparatus is initialized, the ambient temperature is determined based on the signal output by the temperature sensor 280. Next, when image data is received from the image data source 102, the operating mode selected by the user is determined as either "variable speed mode" or "variable density mode". If the selected operating mode is "variable density mode", the selected printing speed is determined.

Next, the controller 220 predicts a future amount of power to be supplied by the low voltage power supply 260 based on the image data from the image data source 102. If the predicted future amount of power to be supplied by the low voltage power supply 260 exceeds its operating power demand threshold, the controller 220 determines a ratio p/n of turned-on pixels to be blocked.

Then, the controller 220 determines the ink drying rate based on the humidity level. If the area coverage of the image corresponding to the ratio p/n and the electrical intensity supplied to the printhead 254 exceeds the ink drying rate, the controller 220 determines a new ratio p/n of turned-on pixels to be blocked.

Next, the controller 220 predicts a future temperature of the printhead 254 based on the actual temperature and the electrical intensity supplied to the printhead 254 and, optionally, also based on the image data from the image data source 102. If the predicted future temperature of the printhead 254 exceeds the operating temperature range of the printhead 254, the controller 220 determines a ratio p/n of turned-on pixels to be blocked.

Next, the pixel blocking circuit 240 turns off p out of n turned-on pixels of the input image and the resulting image is printed at the selected printing speed. The controller 220 repeats the future amount of power to be supplied determination, the future printhead temperature determination, the ink drying rate determination and the ratio p/n determination until all remaining pages of the image are printed.

If the variable-speed operating mode has been selected by the user using the selector 225, the controller 220 determines the selected printing speed.

Then, the controller 220 predicts a future amount of power to be supplied by the low voltage power supply 260, based on the image data from the image data source 102. If the predicted future amount of power to be supplied exceeds the operating power demand threshold of the low voltage power supply 260, the controller 220 determines a revised printing speed.

Then, the controller 220 determines the ink drying rate based on the humidity level. If the area coverage of the image corresponding to the revised speed and the electrical intensity supplied to the printhead 254 exceeds the ink drying rate, the controller 220 further reduces the printing speed.

Then, the controller 220 predicts a future temperature of the printhead 254, based on the actual temperature and the electrical intensity supplied to the printhead 254. If the predicted future temperature exceeds the operating temperature range of the printhead 254, the controller 220 further reduces the printing speed.

Then, the input image is read and printed at the revised printing speed. Determining the amount of power to be supplied, the future printhead temperature, the ink drying rate and a revised printing speed is repeated until no other page is to be printed out.

Specifically, in the exemplary embodiment of the image forming apparatus 200 shown in FIG. 3, the controller 220 determines the ambient temperature based on the signal output by the temperature sensor 280 and then waits for image data to be supplied by the image data source 102. When image data is received from the image data source 102, the controller 220 determines the operating mode selected by the user using the selector 225, by reading an operating mode stored in the random access memory 232. In particular, the operating mode is either "variable speed mode" or "variable density mode." The operating mode is written by the controller 220, upon a request from the user.

The controller 220 then determines whether the selected operating mode is "variable density mode". If not, the controller 220 determines the selected printing speed by reading the selected printing speed that has been stored in the random access memory.

The controller 220 controls the input of data corresponding to an input image from the data source 102 to the image data buffer memory 234. The image data buffer memory 234 stores the input image data corresponding to one page to be printed. The controller 220 also counts the turned-on pixels for each color of the image stored in the image data buffer 234 and stores the number of turned-on pixels in the random access memory 232.

The controller 220 then reads the temperature value corresponding to the signal output by temperature sensor 280 and the humidity value corresponding to the signal output by the humidity sensor 282. The controller 220 also sets the value of a counter p stored in the random access memory 232 to zero.

The controller 220 then predicts the future amount of power to be supplied by the low voltage power supply 260. This future amount of power to be supplied is obtained by inputting, into a look-up table (not shown) stored in the non-volatile memory 236, the selected printing speed and the value of the number of turned-on pixels multiplied by the ratio (n-p)/n and by reading the output of the look-up table.

Next, the controller 220 determines whether the predicted future amount of power to be supplied exceeds the operating power demand threshold of the low voltage power supply 260. If so, the value p is incremented and the future amount of power to be supplied prediction, the test of the predicted future amount of power to be supplied and the incrementation of the value p are reiterated until the predicted future amount of power to be supplied does not exceed the operating power demand threshold of the low voltage power supply 260.

Next, the controller 220 determines the ink drying rate of dryer 270 and the area coverage corresponding to p. The ink drying rate is obtained by inputting, into a look-up table (not shown) stored in the non-volatile memory 236, the actual humidity level as sensed, and by reading the output of the look-up table. The area coverage is equal to the value of the number of turned-on pixels multiplied by the ratio (n-p)/n and by the selected printing speed.

Then, the controller 220 determines whether the area coverage corresponding to p exceeds the ink drying rate of the dryer 270. If so, the value of p is further incremented and the area coverage determination corresponding to p, the test of the area coverage corresponding to p and the incrementation of p are performed until the area coverage corresponding to p does not exceed the ink drying rate of the dryer 270.

The controller 220 then predicts the future temperature of the printhead 254. This future temperature is obtained by inputting, into a look-up table (not shown) stored in the non-volatile memory 236, the actual temperature as sensed, the selected printing speed and the value of the number of turned-on pixels multiplied by the ratio (n-p)/n and by reading the output of the look-up table. In particular, n is a predetermined value stored in the non-volatile memory 236.

Next, the controller 220 determines whether the predicted future temperature exceeds the temperature operating range of the printhead 254. If so, the value p is incremented and the future temperature prediction, the test of the predicted future temperature and the incrementation of the value p are reiterated until the predicted future temperature does not exceed the temperature operating range of the printhead 254.

Next, the input image is read from the image data buffer 234, and the pixel blocking circuit 240 turns off p out of n turned-on pixels of the input image and the resulting image is printed using the selected printing speed.

In contrast, if the variable-density operating mode has not been selected, the controller 220 first counts the turned-on pixels for each color of the image stored in the image data buffer 234 and stores the number of turned-on pixels in the random access memory 232.

Then, the controller 220 determines the selected printing speed by reading the printing speed in the random access memory 232. The selected printing speed is written by the controller 220 into the random access memory 200, upon a request by the user.

The controller 220 next reads the temperature value corresponding to the signal outputted by temperature sensor 280 and the humidity value corresponding to the signal outputted by humidity sensor 282. As above, the controller 220 sets the value of the counter p stored in the random access memory 232 to zero.

The controller 220 then predicts the future amount of power to be supplied by the low voltage power supply 260. This future amount of power to be supplied is obtained by inputting, in a look-up table (not shown) stored in the non-volatile memory 236, the selected printing speed and the value of the number of turned-on pixels multiplied by the ratio (n-p)/n and by reading the output of the look-up table.

The controller 220 then determines whether the predicted future amount of power to be supplied by the low voltage power supply 260 exceeds the operating power demand threshold of the low voltage power supply 260. If so, the controller 220 increments the value of p. The future amount of power to be supplied prediction, the test of the predicted future amount of power to be supplied and the incrementation of p are performed by the controller until the predicted amount of power to be supplied does not exceed the operating power demand threshold of the low voltage power supply 260.

Next, the controller 220 determines the ink drying rate of dryer 270 and the area coverage corresponding to p. The ink drying rate is obtained by inputting, in a look-up table (not shown) stored in the non-volatile memory 236, the actual humidity level as sensed and by reading the output of the look-up table. The area coverage corresponding to p is equal to the value of the number of turned-on pixels multiplied by the ratio (n-p)/n and, further, by the selected printing speed.

The controller 220 next determines whether the area coverage corresponding to p exceeds the ink drying rate of the dryer 270. If so, the controller 220 increments the value of p. The controller 220 repeats the area coverage determination corresponding to p, the test of the area coverage corresponding to p. The incrementation of p until the area coverage corresponding to p does not exceed the ink drying rate of the dryer 270.

The controller 220 then predicts the future temperature of the printhead 254. This future temperature is obtained by inputting, in a look-up table (not shown) stored in the non-volatile memory 236, the actual temperature as sensed, the selected printing speed and the value of the number of turned-on pixels multiplied by the ratio (n-p)/n and by reading the output of the look-up table.

The controller 220 then determines whether the predicted future temperature exceeds the temperature operating range of the printhead 254. If so, the controller 220 increments the value of p, and the future temperature prediction, the test of the predicted future temperature. The incrementation of p are performed by the controller until the predicted temperature does not exceed the temperature operating range of the printhead 254.

Then, the input image is read from the image data buffer 234 and printed using the selected printing speed multiplied by the ratio (n-p)/n.

Figure 4A:
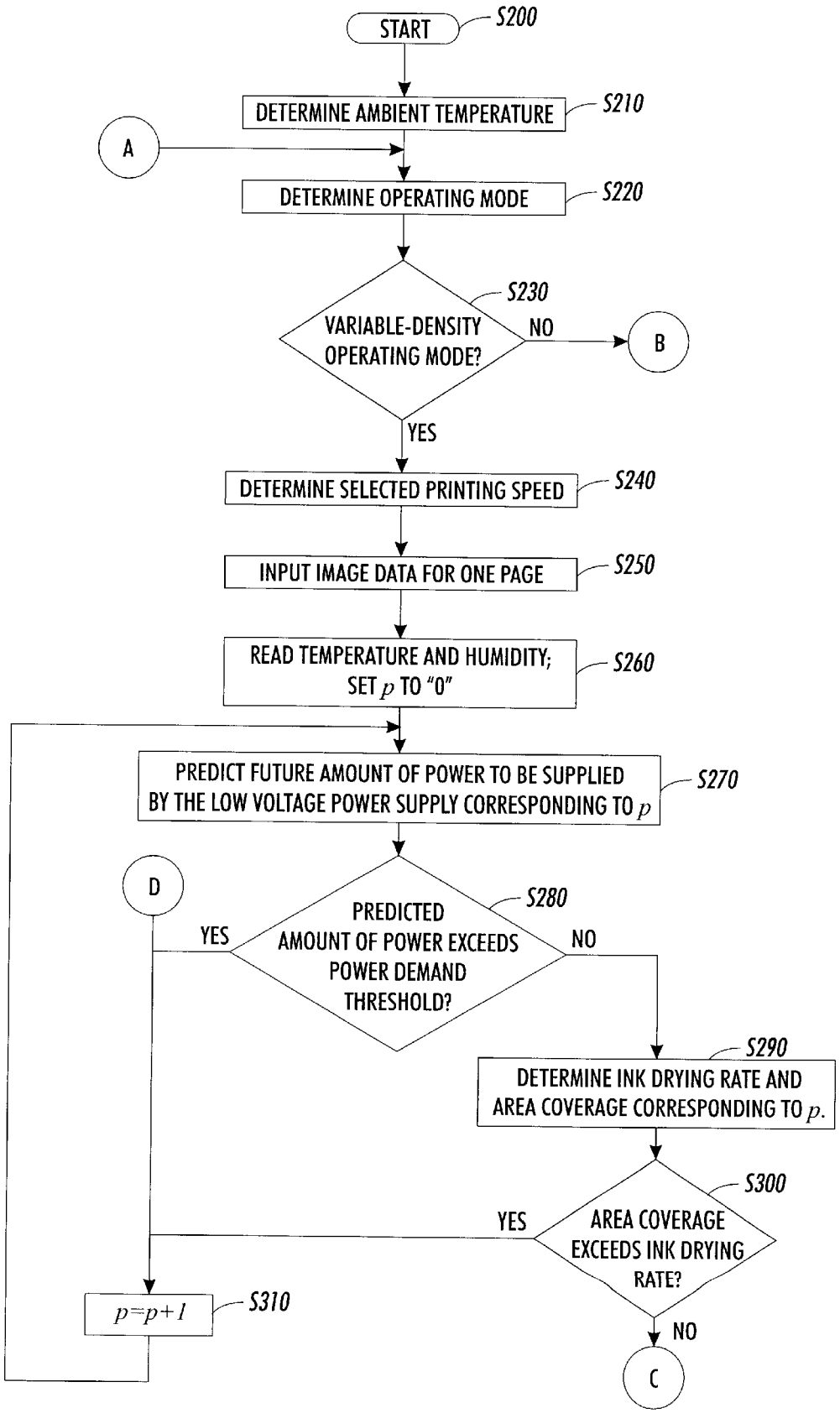
FIGS. 4A, 4B and 4C are a flowchart outlining a second exemplary embodiment of a method according to this invention.
Figure 4B:
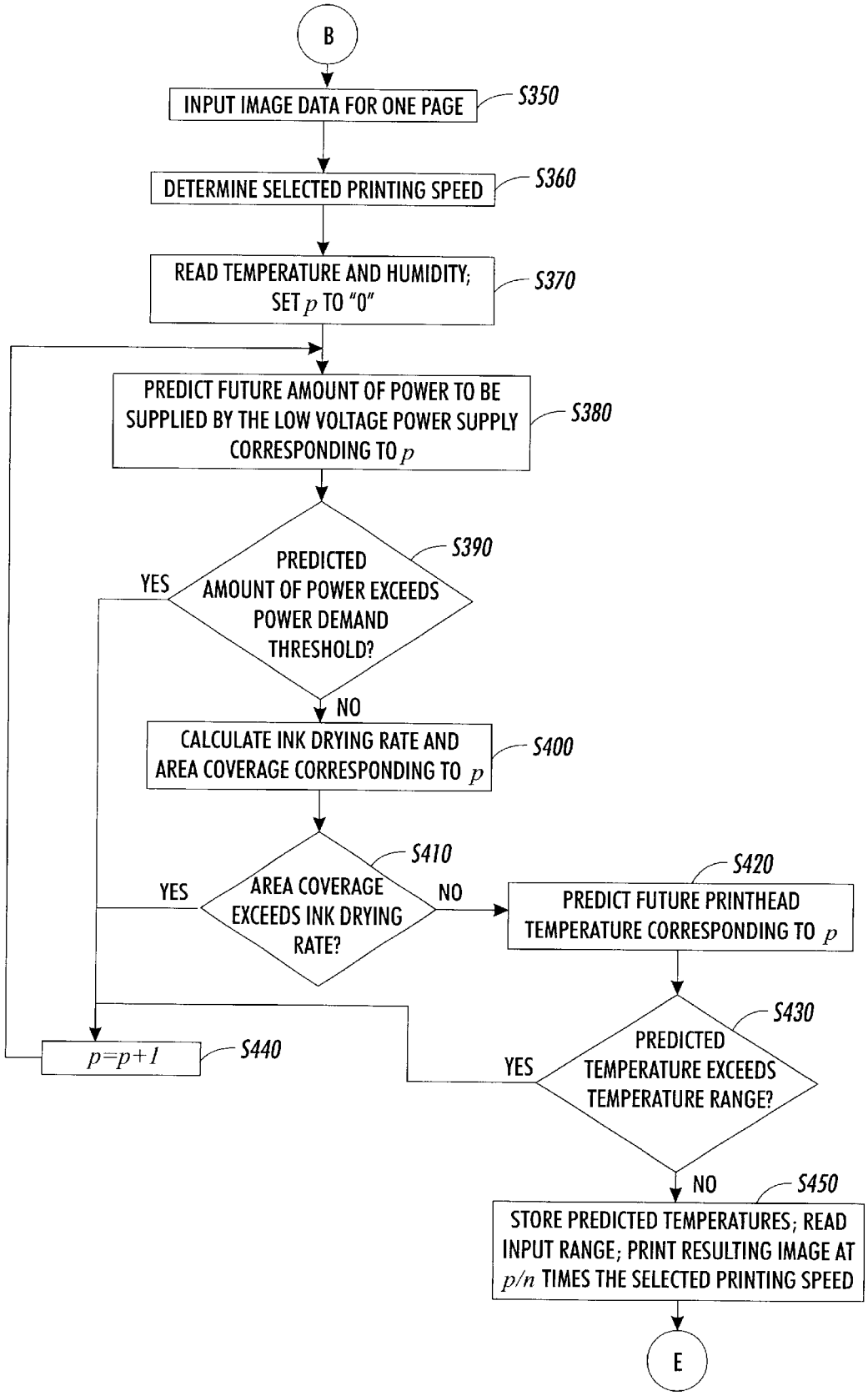
Figure 4C:
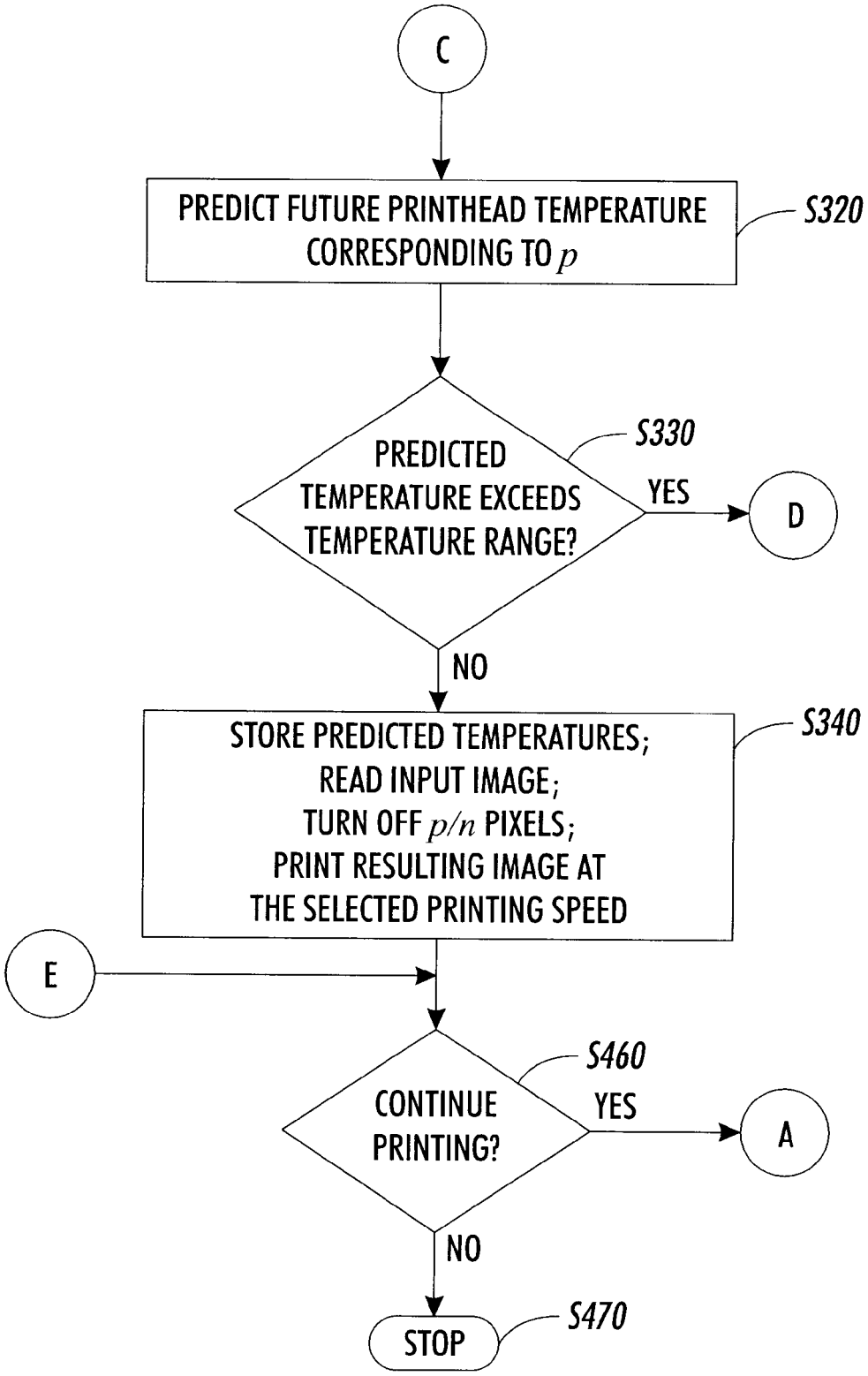

FIGS. 4A, 4B and 4C are a flowchart outlining a second exemplary embodiment of a method according to this invention. Beginning in step S200, control continues to step S210, where the ambient temperature is determined. Next, control continues to step S220, where the operating mode selected by the user is determined as either "variable speed mode" or "variable density mode". Next, in step S230, a determination is made whether the selected operating mode is "variable density mode". When the selected operating mode is "variable-density mode", control continues to step S240. Otherwise, control jumps to step S350.

In step S240, the default printing speed is determined. Then, in step S250, image data corresponding to one page is input and the turned-on pixels for each color of the input image is counted. Next, in step S260, the temperature value and the humidity value are read and the value of a counter p is set to zero. Control then continues to step S270.

In step S270, the future amount of power to be supplied by the low voltage power supply is predicted based on the selected printing speed and the number of turned-on pixels multiplied by a ratio (n-p)/n, where n is a predetermined value. Next, in step S280, a determination is made whether the predicted fixture amount of power to be supplied by the low voltage power supply exceeds the operating power demand threshold of the low voltage power supply. If so, control jumps to step S310. Otherwise, control continues to step S290.

In step S290, the ink drying rate of the dryer and the area coverage corresponding to p are determined. The ink drying rate is obtained based on the actual humidity level. The area coverage corresponding to p is equal to the default printing speed, as determined during step S240, multiplied by the number of turned-on pixels and, further, by the ratio (n-p)/n.

In step S300, a determination is made whether the area coverage of the image to be printed exceeds the ink drying rate of the dryer. When the area coverage of the image to be printed exceeds the ink drying rate, control continues to step S310. Otherwise, control jumps to step S320.

In step S310, the value of p is incremented. Control then returns to step S270.

In step S320, the future temperature of the printhead is predicted based on the actual temperature, the selected printing speed and the number of turned-on pixels multiplied by a ratio (n-p)/n, where n is a predetermined value. Next, in step S330, a determination is made whether the predicted future temperature of the printhead exceeds the temperature operating range of the printhead. When the predicted future temperature of the printhead exceeds the temperature operating range of the printhead, control jumps back to step S310. Otherwise, control jumps to step S340.

In step S340, the predicted temperature of the printhead 154 is saved, the predicted temperature of the low voltage power supply 160 is saved, the input image is printed using the selected printing speed, but with p/n of the turned on pixels being turned off. Control then jumps to step S460.

In step S350, image data corresponding to one page is input and the turned-on pixels for each color of the input image are counted. Then, in step S360, a determination of the selected printing speed is made. Next, in step S370, the temperature value and the humidity value are read and a counter p is set to zero. Control then continues to step S380.

In step S380, the future amount of power to be supplied by the low voltage power supply is predicted based on the selected printing speed and the value of the number of turned-on pixels multiplied by the ratio (n-p)/n, where n is a predetermined value. Next, in step S390, a determination is made whether the predicted future amount of power to be supplied by the low voltage power supply exceeds the operating power demand threshold of the low voltage power supply. If so, control jumps to step S440. Otherwise, control continues to step S400.

In step S400, the ink drying rate of the dryer and the area coverage corresponding to p are calculated. The ink drying rate is based on the actual humidity level. The area coverage corresponding to p is equal to the selected printing speed as determined during step S350, multiplied by the value of the number of turned-on pixels and, further, by the ratio (n-p)/n.

Then, in step S410, a determination is made whether the area coverage corresponding to p exceeds the ink drying rate of the dryer. If so, control jumps to step S440. Otherwise, control continues to step S420.

In step S420, the future temperature of the printhead is predicted based on the actual temperature, the selected printing speed and the value of the number of turned-on pixels multiplied by the ratio (n-p)/n, where n is a predetermined value. Next, in step S430, a determination is made whether the predicted future temperature of the printhead exceeds the temperature operating range of the printhead. If so, control continues to step S440. Otherwise, control jumps to step S450.

In step S450, the predicted temperature of the printhead is saved, the predicted temperature of the low voltage power supply is saved, the input image is printed using the selected printing speed multiplied by the ratio (n-p)/n. Then, in step S460 a determination is made whether another page is to be printed. If so, control returns to step S220. Otherwise, control continues to state S470, where the control routine stops.

In other various exemplary embodiments, the temperature that is sensed is the temperature of the air surrounding the printer and the temperature is used to determine the ink drying rate.

In other various exemplary embodiments, the temperature sensor is located near the printhead, but the temperature of the air surrounding the printer is determined when the printer start operation. That is, the temperature is determined before the printhead is used and heated by the printing operation. This temperature of the ambient air is used to determine the ink drying rate.

As shown in FIGS. 1 and 3, each of the image forming apparatus 100 or 200 is preferably implemented on a programmed general purpose computer. However, each of the image forming apparatus 100 or 200 can also be implemented on a special purpose computer, a programmed microprocessor or microcontroller and peripheral integrated circuit elements, an ASIC or other integrated circuit, a digital signal processor, a hardwire electronic or logic circuit such as a discrete element circuit, a programmable logic device such as a PLD, PLA, FPGA or PAL, or the like. In general, any device, capable of implementing a finite state machine that is in turn capable of implementing the flowcharts shown in FIGS. 2 or 4A–4C, can be used to implement the image forming apparatus 100 or 200, respectively.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A method for printing an image, comprising:

determining a current pixel printing rate for a portion of the image to be printed by a printer used to print the image;

estimating an operating state of the printer based on the current pixel printing rate of the printer;

determining when the estimated operating state exceeds an operating threshold; and when the operating threshold is exceeded, reducing the pixel printing rate of the portion of the image to be printed.

2. The method of claim 1, wherein the step of determining the current pixel printing rate of the printer for the portion of the image to be printed is performed for every recording medium upon which an image is printed.

3. The method of claim 1, wherein:

the estimating step comprises estimating a predicted amount of power to be supplied from a power supply of the printer based on the current pixel printing rate; and the step of determining when the estimated operating state exceeds an operating threshold corresponding to the estimated operating state comprises comparing the predicted amount of power to be supplied from the power supply of the printer to a threshold operating power demand for the power supply.

4. The method of claim 3, wherein, when the predicted amount of power to be supplied from the power supply exceeds the threshold operating power demand for the power supply, the pixel printing rate of at least one portion of the image to be printed is reduced by reducing a number of turned-on pixels in the current image portion to be printed.

5. The method of claim 1, wherein:

the estimating step comprises estimating a printhead temperature of a printhead of the printer based on the current pixel printing rate; and the step of determining when the estimated operating state exceeds an operating threshold comprises comparing the estimated printhead temperature to a threshold printhead temperature.

6. The method of claim 5, wherein, when the estimated printhead temperature exceeds the threshold printhead temperature, the pixel printing rate of at least one portion of the image to be printed is reduced by reducing a number of turned-on pixels in the current image portion to be printed.

7. The method of claim 5, wherein the step of estimating the printhead temperature is further based on a sensed ambient temperature for the printhead.

8. The method of claim 1, wherein:

the estimating step comprises estimating an ink drying rate based on the current pixel printing rate; and the step of determining when the estimated operating state exceeds an operating threshold comprises comparing the estimated ink drying rate to a threshold ink drying rate.

9. The method of claim 8, wherein, when the estimated ink drying rate exceeds the threshold ink drying rate, the pixel printing rate of at least one portion of the image to be printed is reduced by reducing a number of turned-on pixels in the current image portion to be printed.

10. The method of claim 8, wherein the step of estimating the ink drying rate is further based on a sensed ambient humidity for the printer.

11. The method of claim 1, wherein the step of determining the current pixel printing rate of the printer for the portion of the image comprises:

determining a selected printing speed of the printer;

determining a number of turned-on pixels for the portion of the image; and determining the current pixel printing rate from the determined number of turned-on pixels and the selected printing speed.

12. The method of claim 11, wherein the step of determining the selected printing speed of the printer comprises selecting a printing mode for printing the image, the selected printing speed being a predetermined printing speed for the selected printing mode.

13. The method of claim 11, wherein the step of determining the selected printing speed of the printer comprises inputting a selected printing speed selected by a user of the printer.

14. The method of claim 11, wherein the step of determining the selected printing speed of the printer comprises:

determining an amount of image data of the image; and selecting the printing speed based at least in part on the determined amount of image data.

15. The method of claim 1, wherein the step of reducing the pixel printing rate of at least one portion of the image to be printed comprises reducing one of a printing speed and a number of turned-on pixels in the current image portion to be printed.

16. The method of claim 15, wherein the step of reducing the number of turned-on pixels in the current image portion to be printed comprises turning off a predetermined number p out of a predetermined number n of turned-on pixels.

17. A method for printing an image comprising:

determining an operating mode selected by a user of a printer to be used to print the image;

determining a current pixel printing rate for a portion of the image to be printed by the printer used to print the image;

estimating an operating state of the printer based on the current pixel printing rate of the printer;

when the selected operating mode corresponds to a full-speed printing mode, reducing the pixel printing rate of the printer of the portion of the image to be printed when the estimated operating state of the printer exceeds an operating threshold.

18. The method of claim 17, further comprising, when the selected operating mode corresponds to a variable-speed printing mode, reducing the printing speed when the estimated operating state of the printer exceeds the operating threshold corresponding to the estimated operating state.

19. A method for printing an image comprising:

inputting an image portion to be printed by a printer;

selectively blocking turned-on pixels of the image portion using a variable pixel blocking rate based on a pixel printing rate of the image portion, a first pixel blocking rate corresponding to a first pixel printing rate being different from a second pixel blocking rate corresponding to a second pixel printing rate; and printing remaining turned-on pixels of the image portion.

20. A printing device comprising:

an image forming engine;

a controller, coupled to the image forming engine, that determines a current pixel printing rate for a portion of an image to be printed by the image forming engine, the controller estimating an operating state of the image forming engine based on the current pixel printing rate, the controller determining if the estimated operating state exceeds an operating threshold; and a pixel blocking circuit, coupled to the controller, that reduces the pixel printing rate of the portion of the image to be printed when the controller determines that the estimated operating state exceeds the operating threshold.

21. The printing device of claim 20, wherein the pixel blocking circuit reduces the number of turned-on-pixels in the current image portion to be printed to less than a ratio of a maximum pixel printing rate by a current printing speed.

22. The printing device of claim 20, further comprising a power supply, coupled to the image forming engine, wherein the operating state is an amount of power to be supplied by the power supply.

23. The printing device of claim 20, further comprising a humidity sensor, coupled to the controller, that inputs a humidity level, the controller determining the operating state based on the sensed humidity level.

24. The printing device of claim 20, further comprising a temperature sensor, coupled to the controller, that inputs a temperature level, wherein the controller determines the operating state based on the sensed temperature level.

25. The printing device of claim 20, wherein the printing device reduces the pixel printing rate of the portion of the image to be printed by reducing one of a printing speed and a number of turned-on pixels in the current image portion to be printed.

26. The printing device of claim 25, wherein the pixel blocking circuit reduces the number of turned-on pixels in the current image portion to be printed by turning off a predetermined number p out of a predetermined number n of turned-on pixels.

27. A printing device comprising:

an image forming engine;

a selector that selects a printing mode of the printing device;

a controller, coupled to the image forming engine and the selector, and that determines an operating state of the image forming engine, corresponding to a maximum pixel printing rate, the controller estimating an area coverage of an image to be printed by the image forming engine at a given printing speed; and a pixel blocking circuit, coupled to the controller, and that, when the selected operating mode corresponds to a full-speed printing mode, reduces the pixel printing rate of at least one portion of the image to be printed by the image forming engine when the determined operating state of the printer exceeds a threshold.

28. The printing device of claim 27, wherein the controller reduces the printing speed when the selected operating mode corresponds to a variable-speed printing mode and when the determined operating state of the image forming engine exceeds the threshold.

29. A printing device comprising:

an image forming engine;

a pixel blocking circuit, coupled to the imaging forming engine, and that selectively blocks turned-on pixels of an image portion to be printed by the image forming engine, the pixel blocking circuit using a variable pixel blocking rate based on a pixel printing rate of the image portion, a first pixel blocking rate corresponding to a first pixel printing rate being different from a second pixel blocking rate corresponding to a second pixel printing rate; wherein the image forming engine prints the remaining turned-on pixels of the image portion.

* * * * *